US008642932B2

(12) United States Patent
Akers et al.

(10) Patent No.: US 8,642,932 B2
(45) Date of Patent: Feb. 4, 2014

(54) SYSTEM AND METHOD FOR CRANKSHAFT HARDENING

(75) Inventors: Ronald R. Akers, Guntersville, AL (US); Robert John Madeira, Commerce Township, MI (US); Gary M. Campbell, Albertville, AL (US); Dennis McKinney, Boaz, AL (US); Richard McKelvey, Albertville, AL (US)

(73) Assignee: Ajax Tocco Magnethermic Corporation, Warren, OH (US)

( * ) Notice: Subject to any disclaimer, the term of this patent is extended or adjusted under 35 U.S.C. 154(b) by 1987 days.

(21) Appl. No.: 11/555,827

(22) Filed: Nov. 2, 2006

(65) Prior Publication Data

US 2008/0041845 A1 Feb. 21, 2008

Related U.S. Application Data

(60) Provisional application No. 60/821,412, filed on Aug. 4, 2006.

(51) Int. Cl.
*H05B 6/10* (2006.01)
*H05B 6/22* (2006.01)

(52) U.S. Cl.
USPC ..... 219/639; 219/652

(58) Field of Classification Search
USPC ..... 219/635, 637, 639, 640, 641, 652, 672, 219/676, 677, 660, 655
See application file for complete search history.

(56) References Cited

U.S. PATENT DOCUMENTS

| | | | | |
|---|---|---|---|---|
| 3,944,446 | A | | 3/1976 | Bober |
| 4,123,644 | A | | 10/1978 | Sorensen |
| 5,157,231 | A | | 10/1992 | Baeuerle et al. |
| 5,333,480 | A | * | 8/1994 | Berstein ..... 72/110 |
| 5,391,862 | A | * | 2/1995 | Amateau et al. ..... 219/667 |
| 5,451,749 | A | | 9/1995 | Griebel et al. |
| 5,680,693 | A | | 10/1997 | Griebel et al. |
| 6,013,904 | A | | 1/2000 | Storm et al. |
| 6,018,155 | A | | 1/2000 | Storm et al. |
| 6,140,625 | A | | 10/2000 | Gezarzick et al. |
| 6,153,865 | A | | 11/2000 | Storm et al. |
| 6,160,248 | A | | 12/2000 | Ottenwaelder et al. |
| 6,259,076 | B1 | | 7/2001 | Gezarzick et al. |
| 6,274,857 | B1 | | 8/2001 | Loveless et al. |
| 6,362,462 | B1 | | 3/2002 | Merrell et al. |
| 6,399,928 | B1 | | 6/2002 | Gezarzick et al. |
| 6,455,825 | B1 | | 9/2002 | Bentley et al. |
| 6,555,800 | B1 | | 4/2003 | Zahn |
| 6,566,636 | B1 | * | 5/2003 | Bentley et al. ..... 219/665 |
| 6,638,379 | B1 | | 10/2003 | Schulte et al. |
| 7,145,115 | B2 | | 12/2006 | Zahn et al. |
| 7,197,837 | B1 | * | 4/2007 | Blanford et al. ..... 33/555.1 |
| 2005/0002151 | A1 | * | 1/2005 | Dirnfeldner ..... 361/616 |
| 2006/0102620 | A1 | * | 5/2006 | Frankfurt ..... 219/663 |

* cited by examiner

*Primary Examiner* — Henry Yuen
*Assistant Examiner* — Hung D Nguyen
(74) *Attorney, Agent, or Firm* — Fay Sharpe LLP

(57) ABSTRACT

Systems and methods are presented for automated induction hardening of crankshaft bearings while controlling the crankshaft TIR, in which one or more first bearings are hardened by induction heating and quenching, followed by measurement of the crankshaft TIR. The measured TIR is then evaluated and one or more second bearings are hardened using a second induction heating power profile and a second quench flow profile, at least one of which is selectively adjusted according to the measured crankshaft TIR. In this manner, the hardening of the second bearing(s) can counteract any bending or warpage caused by the first hardening process to control the resulting final TIR of the crankshaft.

37 Claims, 6 Drawing Sheets

SYSTEM AND METHOD FOR CRANKSHAFT HARDENING

REFERENCE TO RELATED APPLICATION

This application claims priority to and the benefit of U.S. Provisional Patent Application Ser. No. 60/821,412, filed Aug. 4, 2006, entitled APPARATUS AND METHOD FOR HARDENING BEARING SURFACES OF A CRANKSHAFT, the entirety of which is hereby incorporated by reference.

FIELD OF THE INVENTION

The present invention relates generally to the manufacture of crankshafts and more particularly to systems and methods for hardening crankshaft bearings using induction heating equipment.

INCORPORATION BY REFERENCE

The following United States patents are hereby incorporated by reference in their entireties as background information: Sorensen U.S. Pat. No. 4,123,644; Griebel U.S. Pat. No. 5,451,749; Storm U.S. Pat. No. 6,013,904; Loveless U.S. Pat. No. 6,274,857; Zahn U.S. Pat. No. 6,555,800; and Schulte U.S. Pat. No. 6,638,379.

BACKGROUND OF THE INVENTION

In the manufacture of crankshafts for internal combustion engines, the various bearing surfaces of the crankshaft are hardened using controlled thermal processing. This hardening typically involves precise heating using induction heating equipment in conjunction with quenching, where the process parameters are fine tuned according to the crankshaft dimensions and material to provide a controlled, repeatable, time-temperature treatment profile to harden the critical contact surfaces of the pin and main bearings. This thermal processing, however, may cause bending or other dimensional distortion, in which case the hardened crankshafts must undergo straightening in order to meet manufacturing specifications. This post-hardening straightening is undesirable, as it adds to production costs. In addition, straightening reduces the fatigue limit of the crankshafts. Lowered fatigue limits, in turn, cause engine designers to sacrifice power and/or weight in a given design. Thus, improved crankshaft bearing hardening techniques and systems are desired by which the need for post-hardening straightening can be reduced or eliminated.

SUMMARY OF INVENTION

One or more aspects of the invention are now summarized to facilitate a basic understanding of the invention, wherein this summary is not an extensive overview of the invention, and is intended neither to identify certain elements of the invention, nor to delineate the scope thereof. The primary purpose of the summary, rather, is to present some concepts of the invention in a simplified form prior to the more detailed description that is presented hereinafter. The present invention relates to methods and apparatus for thermal treatment of crankshaft bearings to harden the surfaces thereof while mitigating the distortion caused by the hardening process. The various aspects of the invention may find particular utility in the manufacture of automotive or other crankshafts for use in internal combustion engines by which the need for post-hardening straightening may be mitigated, thereby facilitating the production of lighter crankshafts and/or crankshafts with higher power ratings, while reducing the amount of manufacturing processing and cost compared with conventional crankshaft hardening techniques.

In accordance with one or more aspects of the invention, a system is provided for controlling the TIR (total indicated reading or total indicator run out) of an internal combustion engine crankshaft, which is comprised of first and second bearing hardening stations and a TIR measurement station with one or more probes and associated transducers for measuring the crankshaft TIR after processing in the first hardening station. The individual hardening stations include an induction heating and quenching system for hardening one or more selected bearings of a crankshaft, where the first hardening station operates to inductively harden a first bearing using a first power profile or a first group of bearings using a first set of power profiles. The first station also controls quench flow rate and inductor counter balancing according to corresponding quench flow and counter balance profiles or sets thereof. Following hardening of the first bearing(s), the TIR is measured at the TIR station and a second bearing or a second group of bearings is then hardened according to a second power profile or set of profiles, as well as to quench flow and counter balance profiles or profile sets. The system may be thus used for hardening pin and/or main bearings where the second hardening process adapts according to the TIR measurements so as to improve final crankshaft TIR.

The system, moreover, includes a feedback control element to selectively adjust the second power profile, the second quench flow profile, and/or the second counter balance profile based on the measured TIR. In one embodiment, the nominal power, quench, and/or counter balance profiles used in the induction hardening process are diagnostically generated, with selective modification or adjustment of the second profile(s) based on the measured TIR. In one preferred implementation, the measured TIR is compared with a threshold or acceptance value, for example, a maximum manufacturing specification for acceptable finished crankshaft TIR. If the measured TIR exceeds this threshold, the profile(s) for the second group of bearings is increased by an amount related to the measured TIR value so as to counteract the bending effects of the first hardening process. In this manner, the invention may be advantageously employed to bring the crankshaft TIR back within the allowed TIR range by operation of the second bearing hardening process to reduce the likelihood that post-bearing hardening straightening processing will be needed. In this regard, the bearings processed in the first and second hardening operations may be preferably selected from any number of pin bearings and/or main bearings of a particular crankshaft design according to predetermined trends with respect to the affect of the hardening on the crankshaft TIR such that hardening of the first bearing(s) tends to cause bending of the crankshaft in a first general direction and hardening of the second bearing(s) tends to bend the crankshaft in a generally opposite direction. Through this controlled processing using selective adaptation of the second hardening process, the system generally operates to control the crankshaft TIR and thereby reduce or eliminate the need for additional post-hardening straightening operations and the costs and performance degradation associated therewith. Furthermore, the system may be fully automated including robotic transfer apparatus or other means by which the crankshafts are automatically transferred from the first bearing hardening station to the TIR station after processing at the first bearing hardening station, and then to the second bearing hardening station after the crankshaft TIR is measured.

Further aspects of the invention provide an induction hardening system that includes a first bearing hardening station with an induction heating and quench system for hardening a first bearing or group of bearings of a crankshaft using first power, quench flow, and counter balance profiles or groups of profiles. The system also includes a TIR station that operates to measure the crankshaft TIR after the first hardening processing, as well as a second bearing hardening station with an induction heating and quench system for hardening a second bearing or group of bearings. The second station uses second power, quench, and counter balance profiles (or a second group of such profiles) and includes a controller that receives the measured TIR and selectively adjusts one or more of the second profile(s) in accordance therewith. In one implementation, the controller adjusts the second profile(s) if the measured TIR is greater than a predetermined acceptance value, and otherwise uses the unmodified second profile(s). The induction hardening system may further comprise an operator tunnel or corridor structure proximate at least one of the bearing hardening stations and a wall separating the corridor from the bearing hardening operations with one or more windows allowing an operator to view processing of crankshafts within the at least one bearing hardening station from a short distance, such as about four feet or less.

Still further aspects of the invention involve methods for induction hardening at least two centrifugal bearing surfaces of a crankshaft, whether pin bearings and/or main bearings. The methods comprise induction hardening at least a first bearing of a crankshaft, measuring a crankshaft TIR after induction hardening the first bearing, determining a second power, quench flow, and/or counter balance profile at least partially according to the measured crankshaft TIR, and induction hardening at least a second bearing of the crankshaft using the second profile. In one possible embodiment, the determination of the second profile includes selecting a second predefined profile if the measured crankshaft TIR is less than or equal to a predetermined acceptance value, and adjusting the second predefined profile if the measured crankshaft TIR is greater than the predetermined acceptance value. In this case, the adjustment of the second profile may comprise increasing a power, quench flow, or counter balance level associated with the second predefined profile based at least in part on the measured crankshaft TIR value if the measured crankshaft TIR is greater than the predetermined acceptance value. The methods, moreover, may include automatically transferring the crankshaft from the first bearing hardening station to the TIR station after induction hardening the first bearing, and automatically transferring the crankshaft from the TIR station to the second bearing hardening station after measuring the crankshaft TIR.

BRIEF DESCRIPTION OF THE DRAWINGS

The following description and drawings set forth certain illustrative implementations of the invention in detail, which are indicative of several exemplary ways in which the principles of the invention may be carried out. The illustrated examples, however, are not exhaustive of the many possible embodiments of the invention. Other objects, advantages and novel features of the invention will be appreciated from the following detailed description of the invention when considered in conjunction with the drawings, in which.

DETAILED DESCRIPTION OF THE INVENTION

Figure 1:
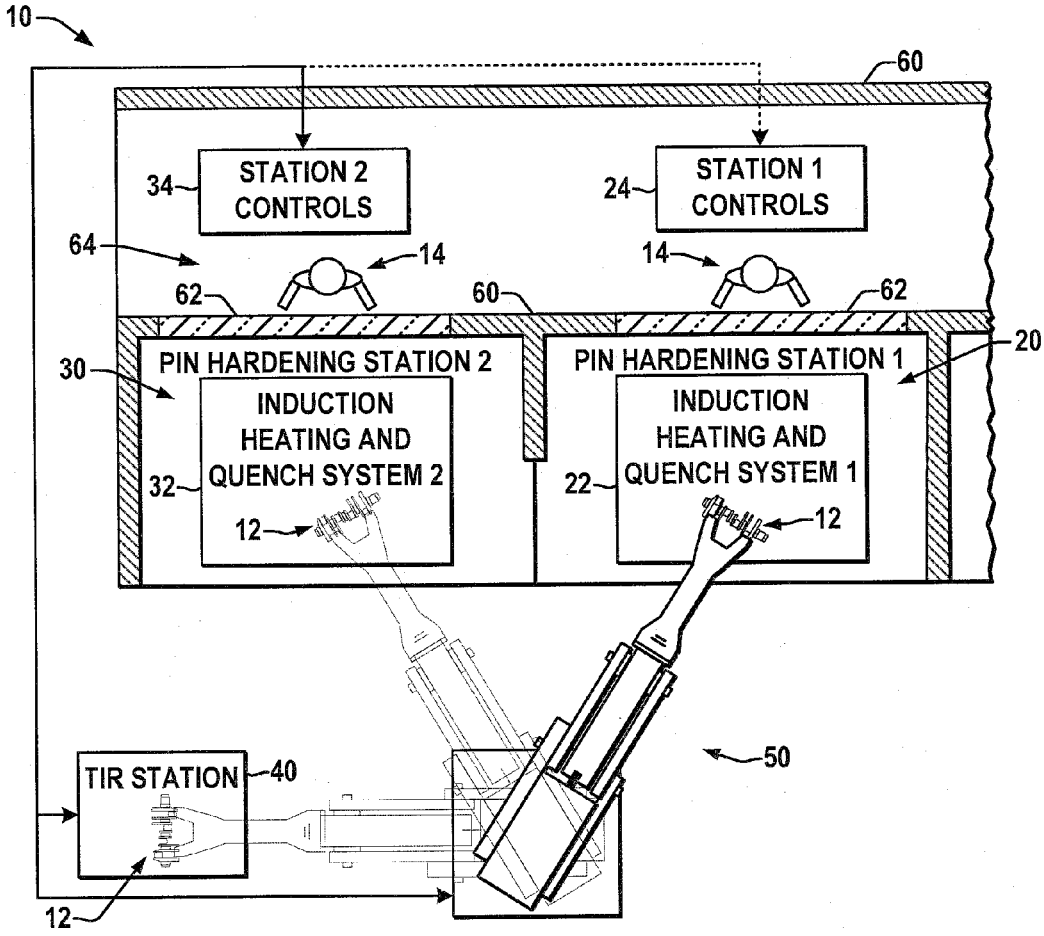
FIG. 1 is a partial sectional top plan view illustrating an exemplary inductive hardening system with first and second bearing hardening stations, a TIR measurement station, and feedback control for adjusting one or more power, quench flow rate, or counter balance profiles used in the second hardening station according to a measured TIR value.

Referring now to the figures, several embodiments or implementations of the present invention are hereinafter described in conjunction with the drawings, wherein like reference numerals are used to refer to like elements throughout. The invention provides methods and systems for selectively adjusting induction hardening power, quench flow, and/or counter balance profiles for a second bearing or group of bearings based upon a crankshaft TIR measured after hardening of a first bearing or bearings, and may be successfully implemented in the manufacture of crankshafts for automotive or other internal combustion engines having any number of centrifugal or orbiting pin bearings and any number of axial main bearings. Thus while illustrated and described hereinafter in the context of manufacturing an exemplary crankshaft with five axial main bearings and four off-axis pin bearings, the invention is generally applicable to production and processing of any number of different crankshaft designs. Furthermore, the invention finds utility in association with any form of inductive bearing hardening systems having induction heating components and quenching components, and may easily be automated to facilitate highly repeatable TIR results with reduced overall crankshaft distortion to reduce or eliminate straightening operations and production costs and to allow greater design flexibility with respect to crankshaft fatigue limits and weight.

Figure 2:
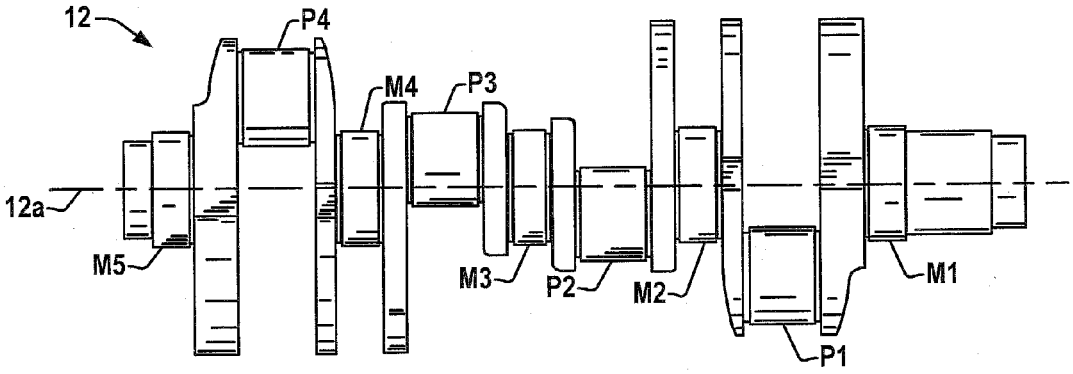
FIG. 2 is a side elevation view illustration of an exemplary crankshaft having four pin bearing surfaces to be hardened in the system of FIG. 1.
Figure 3:
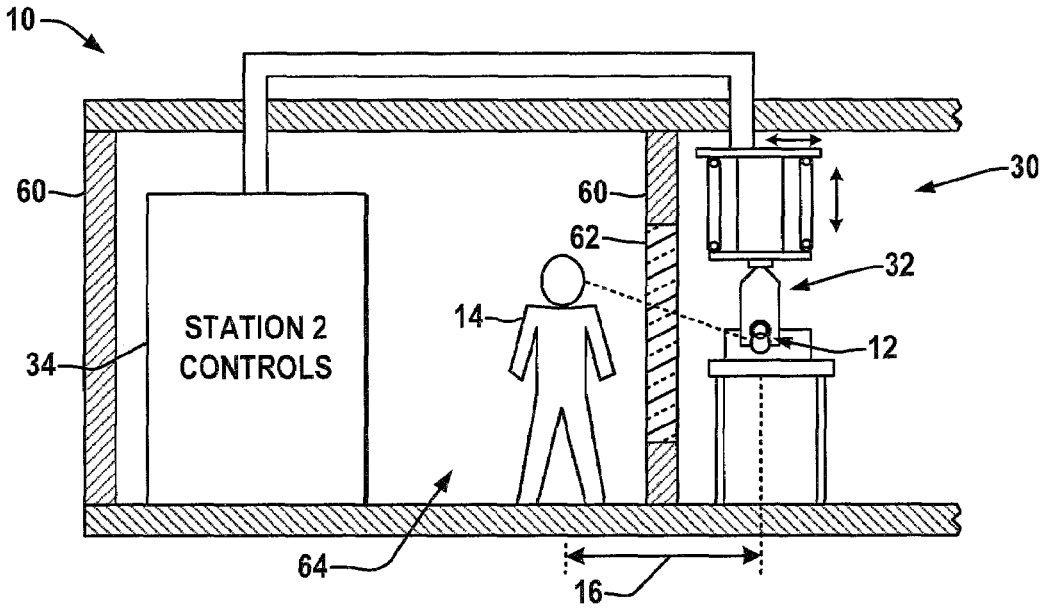
FIG. 3 is a partial sectional side elevation view illustrating a tunnel or corridor structure of the system of FIG. 1 with a window allowing an operator to observe a crankshaft bearing induction hardening process from a short distance.

Referring initially to FIGS. 1-3, a crankshaft bearing hardening system 10 is illustrated, which operates to control the TIR of processed crankshafts 12. Although illustrated hereinafter in the context of application to hardening pin bearings, the principles of the invention are also applicable to hardening main bearings or combinations of main and pin bearings, wherein the illustrated embodiments are merely examples. The exemplary system 10 includes first and second bearing hardening stations 20 and 30 having induction heating and quench systems 22 and 32 for processing first and second sets or groups of bearings, respectively, where the first and second groups may individually include as few as a single bearing. The system includes walls 60 defining the stations 20, 30 and separating the bearing hardening stations 20, 30 from an operator corridor 64. The protective wall 60 includes one or more windows 62 allowing an operator 14 to view processing of crankshafts 12 within one or both of the bearing hardening stations 20, 30 from a short distance 16 (FIG. 3) of about four feet or less in the illustrated embodiment. Each station 20, 30 is controlled for automated or manual operation via corresponding controls 24, 34, respectively, which may also be located within the corridor 64 opposite the process observation windows 62, thereby allowing an operator 14 to view the induction hardening processing of a crankshaft 12 at the corresponding station 20, 30 and to adjust the operation or view displayed information (not shown) associated with the station on the corresponding controls 24, 34. As best shown in FIG. 3, the exemplary second bearing hardening station 30 employs an induction heating and quenching apparatus 32 and a rotatable support for a crankshaft 12 undergoing induction hardening processing, where the window 62 provides an operator 14 with clear line-of-sight observation of the process in the second station 30. In this respect, the hardening system 10 provides the operator 14 with physical process proximity not heretofore available, while ensuring protection from the process environment and mitigating disruption of the processing itself. The corridor structure 64 and the walls 60 may extend beyond the portion shown in FIG. 1 wherein the system 10 may include other processing stations (not shown). For example, in one possible implementation, a main bearing hardening station could be provided before the first bearing hardening station 20, wherein the first station 20 is provided in one embodiment with crankshafts 12 having the main bearings pre-hardened, wherein one or more pin bearings are hardened in the first station 20.

FIG. 2 illustrates further details of the exemplary crankshaft 12, having five coaxial main bearings M1-M5 along a crankshaft axis 12*a*, as well as four centrifugal or off-axis pin bearings P1-P4 interspersed between the main bearings M1-M5. In general, the hardening processing is implemented to inductively heat and then quench harden the bearing surfaces of any of the pin bearings P1-P4 and/or main bearings M1-M5 according to required performance specifications for a given crankshaft design. The various aspects of the current invention are exemplified in the hardening of the pin bearings P1-P4 in this example, wherein the following description assumes that the main bearings have already been hardened by any suitable means, although this is not a requirement of the invention and the main bearings M1-M5 could alternatively be hardened at any suitable point in the crankshaft manufacturing process in the illustrated stations 20, 30, or in other stations (not shown) in any concurrent, prior, subsequent, or intervening process. One objective of the invention is advanced by the provision of crankshafts with hardened bearings P1-P4 and/or M1-M5 without the need for post-hardening straightening operations, although the invention may be employed in production processes that employ such straightening. In this regard, successful application of the various aspects of the invention can mitigate the amount of straightening needed for a given crankshaft 12 or eliminate the need to straighten some or all manufactured crankshafts 12 following the induction hardening processing. In this manner, the system 10 described herein can be advantageously employed in controlling the TIR of the crankshaft 12. Another important goal is the hardening of the crankshaft bearings, wherein the invention addresses both objectives concurrently to provide straight, undistorted crankshafts having the desired tempered hardness and other metallurgical characteristics for the individual cylindrical contact surfaces of the bearings. During processing in the illustrated hardening stations 20, 30, moreover, the pin bearing surfaces orbit about the crankshaft axis 12*a* as the crankshaft 12 is controllably rotated during induction heating, quench hardening, and automatic tempering of the individual bearing surfaces.

Figure 7:
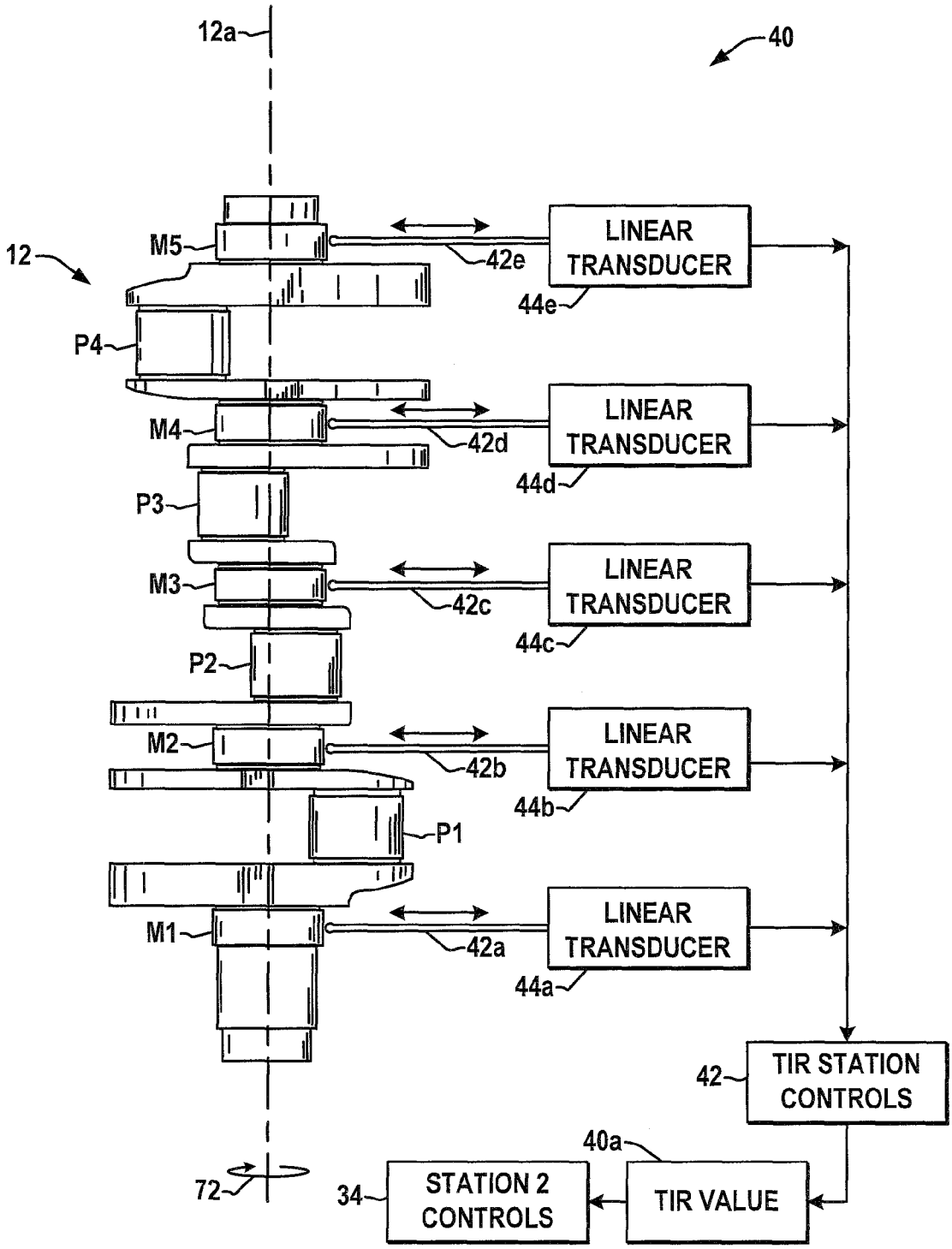
FIG. 7 is a simplified side elevation view illustrating the exemplary crankshaft undergoing TIR measurement using a set of five probes and associated linear transducers to determine a measured TIR value after hardening of an initial set of bearings.

Referring now to FIGS. 1 and 7, the system 10 further includes a measurement or TIR station 40 with at least one probe 42 and a transducer 44 for measuring the TIR of the crankshaft 12 after processing in the first bearing hardening station 20. In this example, moreover, five probes 42*a*-42*e* are provided for engaging the rotating outer surfaces of the main bearings M1-M5, together with corresponding linear transducers 44*a*-44*e*, respectively, wherein the TIR station 40 includes a control element 42 that controllably rotates the measured crankshaft 12 about the axis 12*a* and receives signals from the transducers 44 in order to provide a crankshaft TIR value 40*a* to the controls 34 of the second bearing hardening station 30. In practice, the TIR controls 42 may derive the TIR value 40*a* using any suitable numeric technique, including without limitation averaging the readings from the transducers 44, taking the largest transducer value as the crankshaft TIR value 40*a*, etc.

As shown in FIG. 1, moreover, the exemplary system 10 can be essentially fully automated, with one or more robotic systems 50 for automatically transferring the crankshaft 12 from the first bearing hardening station 20 to the TIR station 40 after processing at the first station 20. The robot system 50 thereafter automatically transfers the crankshaft 12 from the TIR measurement station 40 to the second bearing hardening station 30 once the TIR has been measured. The first hardening station 20 includes induction heating and quench apparatus 22 for inductively heating and quench hardening and inductor counter balance force control apparatus to provide automatic tempering according to given first power, quench flow rate, and counter balance profile for each bearing P or M of a first set or group, which may include a single bearing or multiple bearings, wherein a group can be all pins P, all mains M, or combinations of pin and main bearings, or a single pin or main bearing. In this regard, the various aspects of the invention are generally applicable to any selected first and second bearings or groups thereof.

In one possible example, a first group is selected to include the inner-most pin bearings P2 and P3, wherein the induction hardening thereof tends to cause crankshaft distortion in a first direction. In this example, the remaining two pin bearings P1 and P4 (the outer pins) are hardened as a second group in the second station 30, where the hardening of this exemplary second group of bearings tends to distort the crankshaft 12 in a second generally opposite direction. Consequently, the hardening of the second group will tend to counteract the distortion effects caused by hardening the first group, whereby the overall pin hardening process is less likely to yield distorted crankshafts 12 that require extra straightening steps. Furthermore, the intervening TIR measurement at station 40 allows selective adjustment of the power, quench flow rate, and/or counter balance levels of the profile(s) used in the second station 30 so as to controllably affect the counter bending, whereby the invention can be used to tailor the final TIR to be within allowable tolerance limits while providing the desired tempering of the crankshaft bearing surfaces. Moreover, this concept can be extended to processing in more than two groups, with one or more intervening TIR measurements and correlated adjustment of post-measurement power, quench flow rate, and/or counter balance profiles.

Figure 5:
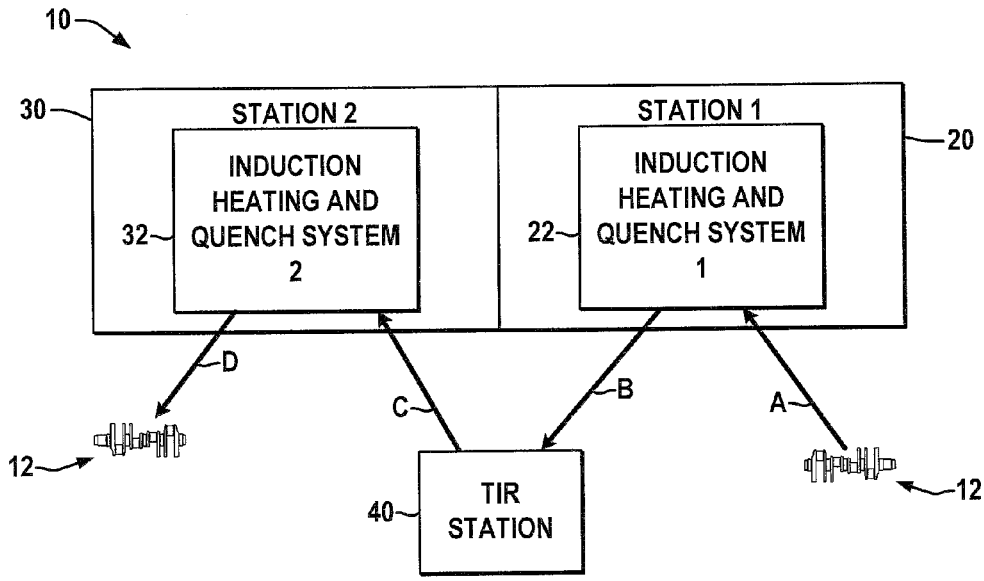
FIG. 5 is a simplified schematic system diagram illustrating the sequence of bearing hardening and TIR measurement operations in the system of FIG. 1.

Referring also to FIG. 5, the crankshaft 12 is provided (at "A" in FIG. 5) to the first bearing hardening station 20 with the main bearings M1-M5 already hardened. A first bearing or first set of bearings is then hardened via the induction heating and quench system 22 according to first power, quench flow, and counter balance profiles or sets of such profiles, which can be diagnostically determined. Following this first processing, the crankshaft 12 is automatically transferred to the TIR station 40 (path "B" in FIG. 5), at which the TIR of the crankshaft 12 is measured. Thereafter, the crankshaft is transferred (path "C") to the second station 30 for controlled processing to harden a second (different) bearing or set of bearings. After the second bearing(s) have been hardened, the crankshaft 12 is removed from station 30 (path "D" in FIG. 5), and may optionally undergo a final TIR measurement. In this regard, the final TIR may be used to determine whether the processed crankshaft 12 is within allowable specifications for distortion, and whether subsequent straightening is needed. It will be appreciated that the robotic system 50 of FIG. 1 or multiple robots 50 may be programmed to perform the transfer operations illustrated in FIG. 5 such that the entire bearing hardening process is fully automated.

Figure 8:
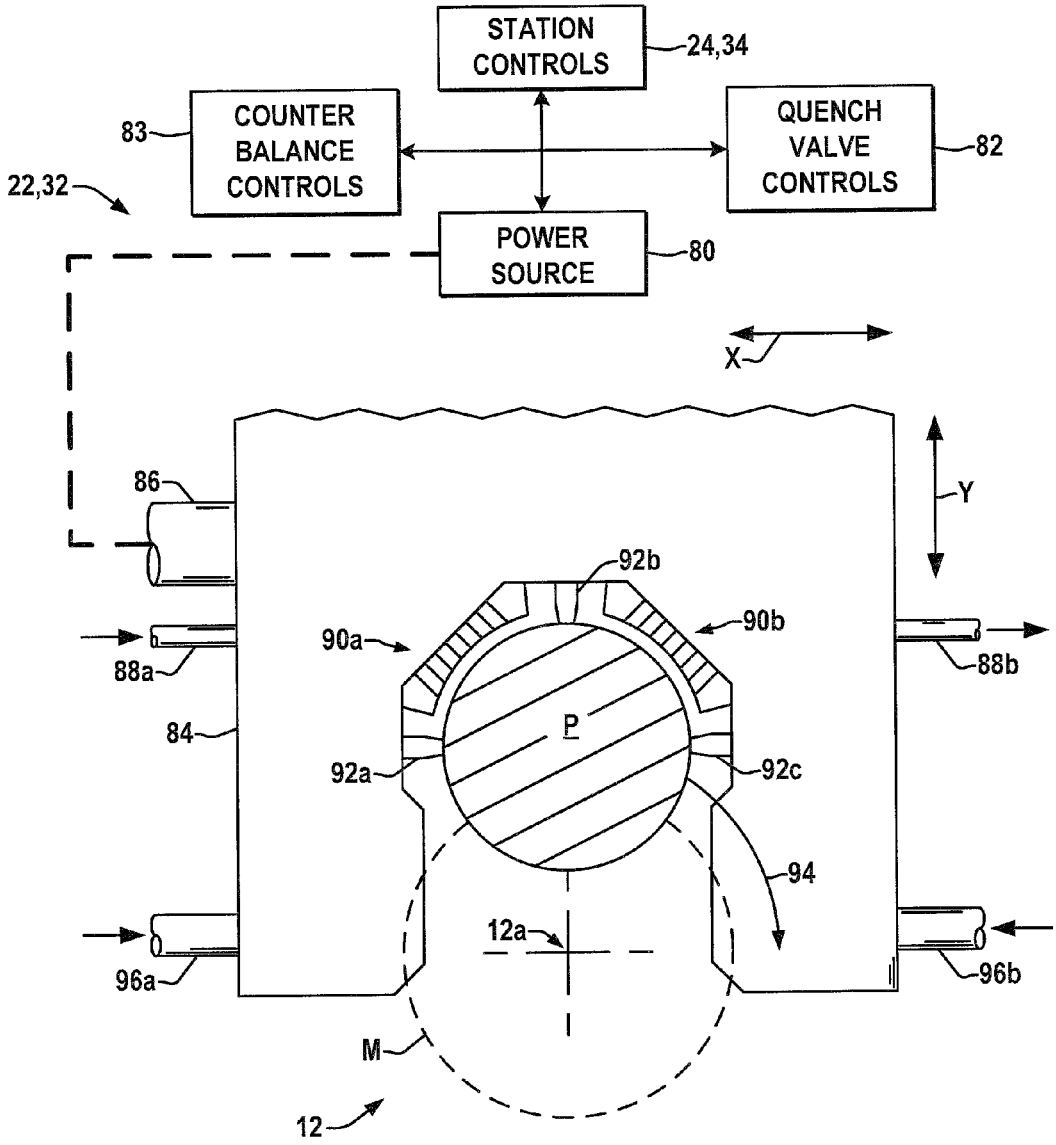
FIG. 8 is a partial side elevation view illustrating an exemplary induction heating and quench system for hardening a crankshaft bearing in the system of FIG. 1.

Referring now to FIG. 8, the induction heating and quench systems 22,32 in the first and second stations 20 and 30 include induction heating and quench systems 22 and 32, respectively, each of which provides at least one inductor structure 84 as depicted in FIG. 8 for hardening of a pin bearing P as it orbits around the shaft axis 12*a* at the center of the main bearings M in a direction indicated by arrow 94. The inductor structure 84 may be any suitable apparatus for performing induction heating and quenching, for example, as generally described in Griebel U.S. Pat. No. 5,451,749 incorporated herein by reference. In the exemplary implementation described herein, a first group of orbiting pin surfaces of pins P2 and P3 are hardened in the first station 20 and a second group is hardened in the second station 30 (P1 and P4), wherein hardening the two groups of bearings with intervening TIR measurement and selective profile adjustment facilitates holding the crankshaft TIR within a desired specification.

The nominal or default power, quench, and counter balance profiles used for the individual bearing hardening processes are preferably generated diagnostically to tailor the desired tempered metallurgical characteristics around the total circumference of each of the hardened bearing surfaces. As shown in FIG. 8, the heating and quenching systems include an inductor assembly for each treated bearing of the corresponding treated group, having a hollow, single turn arcuate conductor 90 with first and second portions 90*a* and 90*b* constructed in the form of laminations and extending in one embodiment over less than 180° of the outer surface of the treated bearing P, with cooling fluid being circulated through the conductor 90 via inlet and outlet lines 88*a* and 88*b*. Three shoes 92*a*, 92*b*, and 92*c* are provided to set the relative position of the conductor 90 with respect to the treated surface of the bearing, wherein the upper shoe 92*b* rides along the top of bearing surface and shoes 92*a* and 92*c* provide lateral alignment to maintain the desired induction heating gap between the bearing surface and the conductor 90. For a given crankshaft 12, the heating gap established by the shoes 92 is preferably designed to provide proper induction heating of the exemplary orbitally rotating pin bearing P in the areas opposite the laminations of the conductor portions 90*a* and 90*b*. For inductive heating of the bearing, electrical power is supplied to the conductor 90 via electrical wiring (not shown) coupled to a power source 80 through conduit 86.

The corresponding hardening station controls 24, 34 provide the necessary control signaling and/or messaging to coordinate and control the rotation of the shaft 12 and the corresponding lateral and vertical translation of the inductor structure 84, along with controlling the operation of the power source 80 and hence the inductive heating of the bearing, quench valve controls 82 for controlling the quench hardening of the treated bearing, and counter balance controls 83 to control counter balance force provided to the inductor structure 84. Quenching liquid is directed into the inductor assembly via liquid supply lines 96*a* and 96*b* under control of quench valve controls 82 and appropriate valves, supply lines, and nozzles (not shown) to propel the quench fluid against the bearing after the conductor 90 has inductively heated the surface thereof. In addition, the structure provides inlet and outlet fluid couplings 88*a* and 88*b*, respectively, to allow coolant liquid to flow through the hollow conductor 90, whereby both coolant and electrical power are directed to the inductor 90. Because the treated pin bearing P is off-axis with respect to the main bearing axis 12*a* in the illustrated example, the treatment system is operably mounted for controlled movement of the structure 84 in the X and Y directions by suitable means (not shown), such that as the pin bearing P orbits in the path direction indicated by arrow 94, the structure 84 follows the orbital pin bearing movement in concert with the support mechanism that rotates the crankshaft 12 about the main bearing axis 12*a*. In addition, the movable mounting structure supporting the inductor structure 84 preferably includes counter balancing apparatus operated according to the controls 83 to maintain the gapped relationship of the pin bearing P and the structure 84 via the shoes 92 without exerting undue force on the surface of the treated bearing P. Treatment apparatus for the axial main bearings M, of course, does not require such moving mounting structures, wherein a hardening station may be equipped with one or more moving inductor mountings for hardening pin bearings and/or one or more non-moving inductor mounts for treatment of main bearings.

The electrical power is provided to the conductor 90 for inductively heating the illustrated pin bearing P from the power source 80 to implement a power profile, such as a waveform current profile tailored to the desired thermal treatment, which in combination with the quenching, achieves the desired tempering of the treated bearing. In this regard, the power profile, quenching, and timing of the process are preferably controlled to provide automatic tempering of the treated bearing. In the first station 20, the heating and quench system 22 hardens at least a first bearing using a given first power profile, wherein multiple profiles can be used to harden multiple corresponding bearings if the first set includes more than one bearing.

The profiles, moreover, may be diagnostically generated prepatory to the full-scale manufacturing process into which the invention may be incorporated. One suitable diagnostic profiling technique is illustrated in co-pending U.S. patent application Ser. No. 11/555,789, filed on Nov. 2, 2006, owned by the assignee of the present invention, the entirety of which is hereby incorporated by reference as if fully set forth herein. In this example, a profile is created for the power level, quench fluid flow level, and counter balance force level at each 10° arcuate increment over the entire 3600 span of the pin bearing P, and a separate set of such profiles is created for each treated bearing of the crankshaft 12. The profiles may be stored and used by the corresponding station controls 24, 34 in any suitable form or location, such as a look up table stored in memory internal to, or otherwise accessible by, the controls 24, 34, wherein the power source 80, quench valve controls 82, and counter balance controls 83 operate to set the levels of the applied power signals, the amount of quench fluid flow, and counter balance force based on the lookup table profile entries in concert with the rotation of the processed shaft 12. In this manner, the power, quench, and counter balance levels are set to the profiled values corresponding to the specific angular segments of the treated pin bearing P as the crankshaft 12 is rotated about axis 12*a*.

For diagnostically determining the nominal power, quench, and counter balance profiles, prior to a production run, a particular bearing surface is heated and quenched according to a default set of profiles, and the resulting hardened surface of the test shaft 12 is analyzed metallurgically in a laboratory to determine the metallurgical characteristics around the bearing surface. To the extent that the treated surface does not have the desired characteristics at all locations, one or more of the profiles are modified or adjusted. This process may be iterated one or more times for each bearing surface to derive a nominal set of profiles for production, which are thus diagnostically determined, and which are stored in or otherwise accessible by the controls 24, 34. In the illustrated example, therefore, the first station controls 24 will store diagnostically generated profiles for the inner pin bearings P2 and P3 of the first set, and the second station controls 34 will employ diagnostically generated profiles (selectively adjusted) for the set of outer pins P1 and P4.

Figure 4:
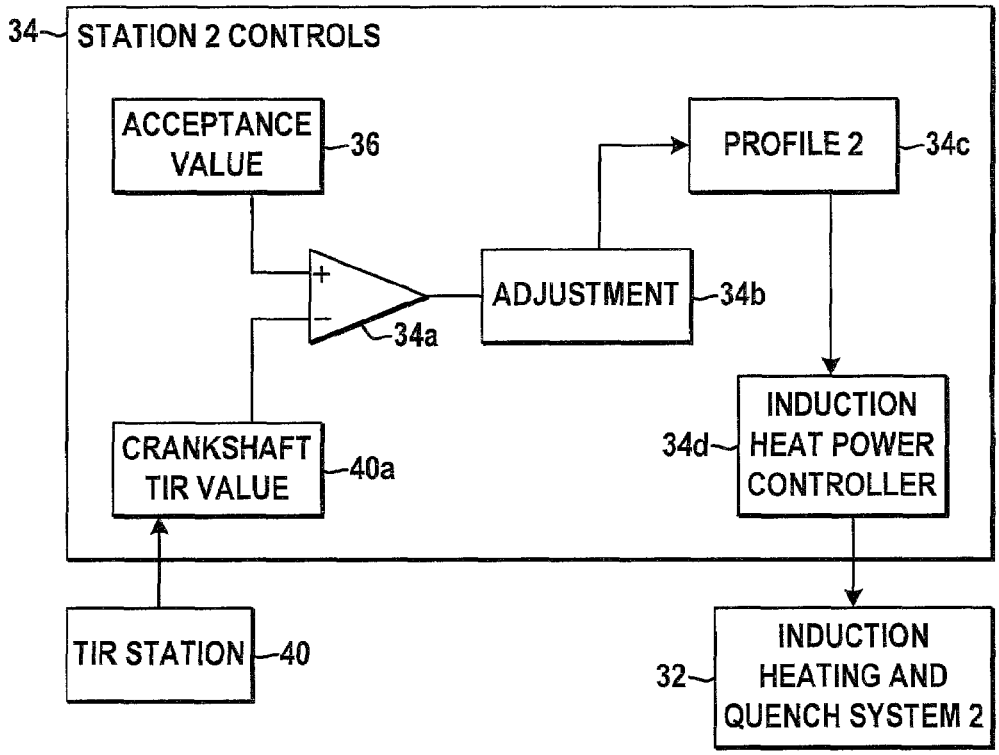
FIG. 4 is a schematic diagram illustrating feedback control aspects of the controls for the second bearing hardening station in the system of FIG. 1.
Figure 6:
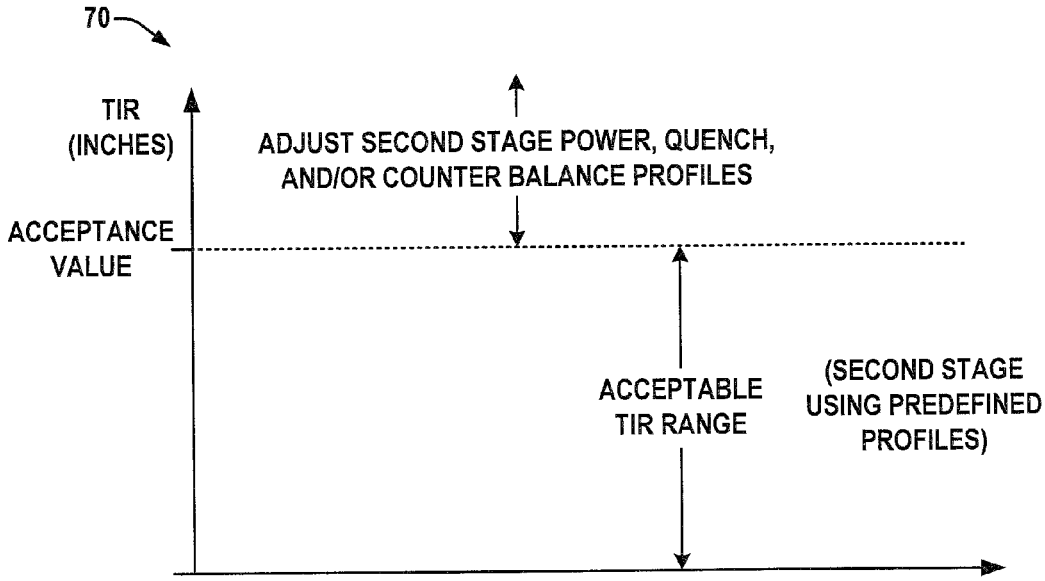
FIG. 6 is a graph illustrating an exemplary TIR acceptance value for the crankshaft of FIG. 2 defining an acceptable TIR range in which the system of FIG. 1 uses an unmodified second power, quench flow, and counter balance profiles or sets of profiles for hardening a second bearing or set of bearings, and a range above the acceptance limit in which the system selectively adjusts the second profiles or profile sets for processing the second bearing(s)

Referring now to FIGS. 1, 4, and 6, with these diagnostically generated nominal profiles for the pin bearings P1-P4, the crankshaft 12 is provided initially to the first station 20, and the induction heating and quench system 22 thereof is operated according to the corresponding profiles to harden pins P2 and P3. The shaft 12 is then transferred by the robot system 50 to the TIR station 40, and the crankshaft TIR value 40*a* is measured and provided to the station 2 controls 34 (FIG. 4). The second pin hardening station 30 then selectively adjusts the power, quench flow, and/or counter balance profiles for the second set of pin bearings P1 and P4 according to the measured TIR value 40*a*, and the crankshaft 12 is transferred by the robot 50 to the second hardening station 30. FIG. 6 shows a graph 70 illustrating an exemplary TIR acceptance value for the crankshaft 12, which defines an acceptable TIR range in which the system 10 uses the unmodified, diagnostically determined power profiles for hardening the second set of pin bearings P1 and P4 at station 30, as well as a range above the acceptance limit in which the control system 34 selectively adjusts the second set of profiles for hardening P1 and P4 in the second station 30. In a preferred implementation, moreover, the control 34 adjusts one or more of the second set of profiles by an amount related to the degree to which the measured TIR value 40*a* exceeds the acceptance value. In this manner, the higher the amount of unacceptable bend resulting from the initial bearing hardening in the first station 10, the higher the amount of correction that is applied by adjusting the profile(s) used in the processing in the second station 30. In one possible implementation, the amount of adjustment is linearly related to (e.g., proportional to) the extent of the measured TIR beyond the acceptance value, although any suitable adjustment algorithm can be used which may be a fixed adjustment or the amount of adjustment may be related to the amount of error in the measured TIR.

FIG. 4 illustrates exemplary feedback control aspects of the second station controls 34, wherein the controls 34 receive the measured crankshaft TIR value 40*a* from the TIR station 40. While illustrated schematically in FIG. 4, the control, comparison, and adjustment functionality can be implemented in any suitable hardware, software, firmware, or combinations thereof. A comparator 34*a* (or software comparison function) determines whether the measured TIR value 40*a* exceeds the acceptance value 36, and provides the comparison result to an adjustment component 34*b*. The component 34*b* selectively adjusts the second profile set 34*c* (e.g., the diagnostically determined power, quench flow rate, and/or counter balance profiles for the second set of bearings P1 and P4 in the above described example) based on the measured TIR 40*a*, and provides the profile 34*c* (adjusted or not depending on the value 40*a*) to the induction heat power controller 34*d* for providing corresponding signals, messages, etc. to the induction heating and quench system 32 of the second station 30.

Figure 9:
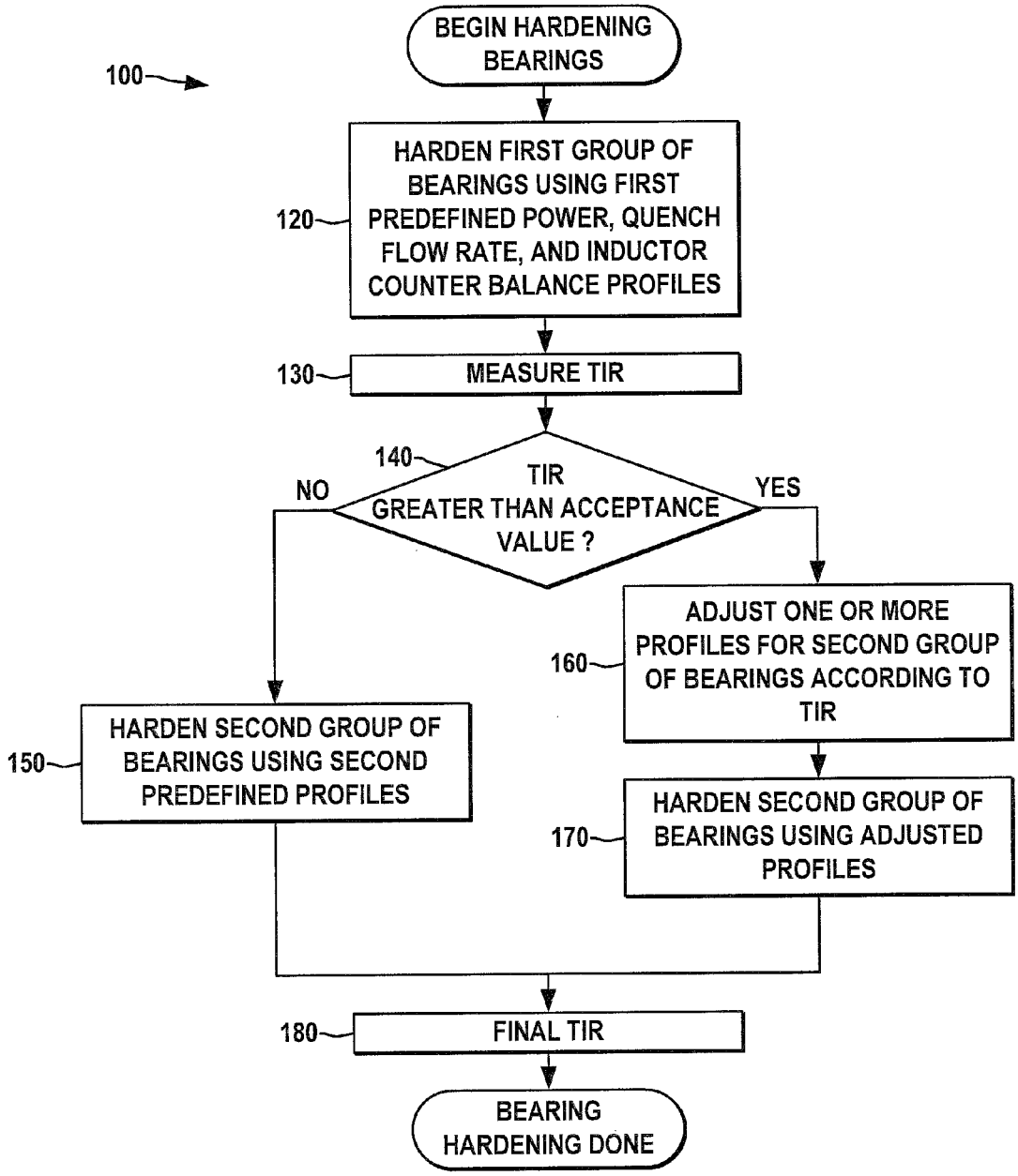
FIG. 9 is a flow diagram illustrating an exemplary method for bearing hardening in accordance with further aspects of the invention.

FIG. 9 illustrates an exemplary method 100 for hardening pin and/or main bearings of a crankshaft in accordance with certain aspects of the invention. Although the exemplary method 100 is illustrated and described below as a series of acts or events, it will be appreciated that the present invention is not limited by the illustrated ordering of such acts or events except as specifically set forth herein. For example, some acts may occur in different orders and/or concurrently with other acts or events apart from those illustrated and/or described herein, in accordance with the invention. In addition, not all illustrated steps may be required to implement a methodology in accordance with the present invention. Moreover, the methods of the invention may be carried out in conjunction with various systems, apparatus, and workpieces illustrated and described herein, as well as in association with other structures that are not illustrated or specifically discussed. At 120, a first set or group of bearings is hardened at a first station using a first set of predefined power and quench flow rate profiles, where the sets can include a single bearing and a single profile, or multiple bearings can be hardened at 120 using a set of corresponding profiles. Furthermore, if the hardened bearings are pin bearings, the hardening may also be done using corresponding counter balance profiles. At 130, a crankshaft TIR is determined (e.g., measured) after induction hardening the first bearing(s). Second power, quench flow rate, and/or counter balance profiles are then determined at least partially according to the measured crankshaft TIR. In the illustrated example, a determination is made at 140 as to whether the measured TIR is greater than an acceptance value. If not (NO at 140), no adjustments are made and the second group of bearings is hardened at 150 using a second group of predefined profiles (or a single unmodified set of profile to harden a single bearing). Thereafter at 180, a final TIR measurement may be made, although not a strict requirement of the invention, and the bearing hardening process is finished. If, however, the measured TIR is above the acceptance value (YES at 140), the second predefined power profile, quench flow rate profile, and/or counter balance profiles (or group of profiles) are adjusted at 160 according to the measured TIR value. Thereafter at 170, the second group of bearings is hardened at 170 using the adjusted or modified second group of power profiles (or a single adjusted set of profiles to harden a single bearing), followed by an optional final TIR measurement at 180 to complete the process.

The above examples are merely illustrative of several possible embodiments of various aspects of the present invention, wherein equivalent alterations and/or modifications will occur to others skilled in the art upon reading and understanding this specification and the annexed drawings. In particular regard to the various functions performed by the above described components (assemblies, devices, systems, circuits, and the like), the terms (including a reference to a "means") used to describe such components are intended to correspond, unless otherwise indicated, to any component, such as hardware, software, or combinations thereof, which performs the specified function of the described component (i.e., that is functionally equivalent), even though not structurally equivalent to the disclosed structure which performs the function in the illustrated implementations of the invention. In addition, although a particular feature of the invention may have been disclosed with respect to only one of several implementations, such feature may be combined with one or more other features of the other implementations as may be desired and advantageous for any given or particular application. Also, to the extent that the terms "including", "includes", "having", "has", "with", or variants thereof are used in the detailed description and/or in the claims, such terms are intended to be inclusive in a manner similar to the term "comprising".

Having thus described the invention, the following is claimed:

1. A system for controlling a TIR (Total Indicated Reading) of a crankshaft for an internal combustion engine having a plurality of centrifugal bearing surfaces, the system comprising:

a first bearing hardening station with an induction heating and quench system for hardening at least a first bearing group of bearings of a crankshaft using a first power profile and a first quench flow rate profile, at least one bearing of said first group of bearings located between a plurality of bearings of a second group of bearings, the first bearing hardening station hardens a first group of bearings of the crankshaft using given first power and quench flow rate profiles;

a TIR station with at least one probe and a transducer for measuring a crankshaft TIR after processing said first group of bearings in said first bearing hardening station;

a second bearing hardening station with an induction heating and quench system for hardening said second group of bearings on said crankshaft using a second power profile and a second quench flow rate profile;

a system to determine or measure said crankshaft TIR after processing said first group of bearings in said first bearing hardening station by said first power profile; and a feedback control to adjust said second power profile, said second quench flow rate profile, or combinations thereof based on said determined or measured crankshaft TIR, said second power profile being adjusted prior to said second group of bearings on said crankshaft being hardened in said second bearing hardening station.

2. The system as defined in claim 1, wherein said first bearing hardening station hardens said first group of bearing using a given first counter balance profile for controlling counterbalance of a first inductor of the first station, wherein said second bearing hardening station hardens said second group of bearing using a second counter balance profile for controlling counterbalance of a second inductor of said second station, and wherein said feedback control system adjusts at least one of the second power profile, said second quench flow rate profile, and said second counter balance profile based on said determined or measured TIR.

3. The system as defined in claim 1, wherein said first group of bearings are main bearings.

4. The system as defined in claim 1, wherein the first and second profiles are diagnostically generated.

5. The system as defined in claim 1, further comprising; means for transferring said crankshaft from said first bearing hardening station to said TIR station after processing said first group of bearings at said first bearing hardening station, and means for transferring said crankshaft from the TIR station to said second bearing hardening station after said crankshaft TIR is determined or measured.

6. The system as defined in claim 5, wherein said first bearing hardening station hardens said first group of bearings using a given first counter balance profile for controlling counterbalance of a first inductor of the first station, wherein said second bearing hardening station hardens said second group of bearings using a second counter balance profile for controlling counterbalance of a second inductor of said second station, and wherein said feedback control system adjusts at least one of the second power profile, said second quench flow rate profile, and said second counter balance profile based on said determined or measured TIR.

7. The system as defined in claim 6, wherein said first group of bearings are main bearings.

8. The system as defined in claim 6, wherein said first group of bearings is located between a plurality of bearings of said second group of bearings.

9. The system as defined in claim 1, wherein said first group of bearings is located between a plurality of bearings of said second group of bearings.

10. A system for controlling a TIR (Total Indicated Reading) of a crankshaft for an internal combustion engine having a plurality of centrifugal bearing surfaces, said system comprising:

a first hearing hardening station with an induction heating and quench system for hardening a first group of bearings of a crankshaft using a first power profile and a first quench flow rate profile;

a TIR station with at least one probe and a transducer for measuring or determining a crankshaft TIR after heating and quenching is completed in said first hearing hardening station, said TIR station determines said crankshaft TIR while no heating and quenching of the crankshaft is occurring;

a second hearing hardening station with an induction heating and quench system for hardening a second group of bearings of said crankshaft using a second power profile and a second quench flow rate profile, said first group of bearings hardened prior to said hardening of said second group of bearings; and a controller receiving said measured or determined crankshaft TIR and selectively adjusting said second power profile, said second quench flow rate profile, or combinations thereof according to said measured or determined TIR, said second power profile being adjusted prior to said crankshaft being hardened in said second bearing hardening station.

11. The system as defined in claim 10, including a system to determine said crankshaft TIR after processing said first group of bearings in said first bearing hardening station by said first power profile.

12. The system defined in claim 11, wherein said controller includes feedback control.

13. The system as defined in claim 12, further comprising a transfer arrangement to automatically transfer said crankshaft from said first bearing hardening station to said TIR station after said first group of bearings are hardened at said first bearing hardening station, and a transfer arrangement to automatically transfer said crankshaft from said TIR station to said second bearing hardening station after said crankshaft TIR is measured or determined.

14. The system defined in claim 13, wherein said first bearing hardening station hardens said first group of bearings using a given first counter balance profile for controlling counterbalance of a first inductor of said first bearing hardening station, and said second bearing hardening station hardens said second group of bearings using a second counter balance profile for controlling counterbalance of a second inductor of said second bearing hardening station, said controller adjusting at least one of said second power profile, said second quench flow rate profile, said counter balance profile, or combinations thereof based on said measured or determined TIR.

15. The system as defined in claim 14, wherein said controller adjusts said second profile if said measured or determined TIR is greater than a predetermined acceptance value.

16. The system as defined in claim 15, wherein adjusting of said second profile includes modifying a power level, modifying a quench flow rate level, or combinations thereof associated with said second profile based at least in part on said measured or determined crankshaft TIR value if said measured crankshaft TIR is greater than said predetermined acceptance value.

17. The system as defined in claim 16, wherein said first group of bearings are main hearings.

18. The system as defined in claim 16, wherein said first group of hearings is located between a plurality of bearings of said second group of bearings.

19. The system as defined in claim 18, further comprising an operator corridor structure proximate at least one of said bearing hardening stations and a wall separating at least one of said bearing hardening stations from said corridor, said wall comprising at least one window allowing an operator to view processing of said crankshaft within at least one of said bearing hardening stations.

20. The system defined in claim 10, wherein said controller includes feedback control.

21. The system defined in claim 10, wherein said first bearing hardening station hardens said first group of bearings using a given first counter balance profile for controlling counterbalance of a first inductor of said first bearing hardening station, and said second bearing hardening station hardens said second group of bearings using a second counter balance profile for controlling counterbalance of a second inductor of said second bearing hardening station, said controller adjusting at least one of said second power profile, said second quench flow rate profile, said counter balance profile, or combinations thereof based on said measured or determined TIR.

22. The system as defined in claim 10, wherein said first group of bearings are main bearings.

23. The system as defined in claim 10, wherein said first profile, said second profile, or combinations thereof are diagnostically generated.

24. The system as defined in claim 10, wherein said controller adjusts said second profile if said measured or determined TIR is greater than a predetermined acceptance value.

25. The system as defined in claim 24, wherein adjusting of said second profile includes modifying a power level, modifying a quench flow rate level, or combinations thereof associated with said second profile based at least in part on said measured or determined crankshaft TIR value if said measured crankshaft TIR is greater than said predetermined acceptance value.

26. The system as defined in claim 10, further comprising a transfer arrangement to automatically transfer said crankshaft from said first bearing hardening station to said TIR station after said first group of bearings are hardened at said first bearing hardening station, and a transfer arrangement to automatically transfer said crankshaft from said TIR station to said second bearing hardening station after said crankshaft TIR is measured or determined.

27. The system as defined in claim 10, further comprising an operator corridor structure proximate at least one of said bearing hardening stations and a wall separating at least one of said bearing hardening stations from said corridor, said wall comprising at least one window allowing an operator to view processing of said crankshaft within at least one of said bearing hardening stations.

28. The system as defined in claim 10, wherein said first group of bearings is located between a plurality of bearings of said second group of bearings.

29. A system for controlling a TIR (Total Indicated Reading) of a crankshaft having a plurality of bearing surfaces, said system comprising:

a first bearing hardening station with an induction heating and quench system for hardening a first group of bearings of said crankshaft using a first power profile;

a second bearing hardening station with an induction heating and quench system for hardening a second group of bearings of said crankshaft using a second power profile;

a TIR station for measuring a crankshaft TIR after hardening and quenching said first group of bearings of said crankshaft in said first bearing hardening station;

a transfer arrangement to move said crankshaft, said transfer arrangement moving said crankshaft from said first bearing hardening station to said TIR station after said first group of bearings of said crankshaft has been hardened, said transfer arrangement moving said crankshaft from said TIR station to said second bearing hardening station after said crankshaft TIR has been measured or determined; and a control system to mdify said second power profile of said induction heating and quench system in said second bearing hardening station prior to hardening of said second group of bearings, only when said measured crankshaft TIR is greater than a predetermined acceptance TIR value so as to mitigate a need for post-hardening straightening of said crankshaft.

30. The system as defined in claim 29, wherein at least one bearing of said first group of bearings is positioned between a plurality of bearings of said second group of bearings.

31. The system as defined in claim 30, wherein said crankshaft TIR is measured in said TIR station while no heating and quenching of said crankshaft occurs.

32. The system as defined in claim 31, wherein said control system receives the measured or determined crankshaft TIR and selectively adjusts said second power profile, said second quench flow rate profile, or combinations thereof according to said measured or determined TIR.

33. The system as defined in claim 32, wherein said first group of bearings are main bearings.

34. The system as defined in claim 32, wherein said first group of bearings is located between a plurality of bearings of said second group of bearings.

35. The system as defined in claim 29, wherein said crankshaft TIR is measured in said TIR station while no heating and quenching of said crankshaft occurs.

36. The system as defined in claim 29, wherein said control system receives the measured or determined crankshaft TIR and selectively adjusts said second power profile, said second quench flow rate profile, or combinations thereof according to said measured or determined TIR.

37. The system as defined in claim 29, wherein said first group of bearings are main bearings.

* * * * *